US005243959A

United States Patent [19]

Savage

[11] Patent Number: 5,243,959

[45] Date of Patent: Sep. 14, 1993

[54] ARCHERY APPARATUS AND METHOD

[75] Inventor: Huey P. Savage, Lake Forest, Calif.

[73] Assignee: Savage Systems, Inc., San Clemente, Calif.

[21] Appl. No.: 919,052

[22] Filed: Jul. 23, 1992

Related U.S. Application Data

[63] Continuation-in-part of Ser. No. 859,998, Mar. 30, 1992, abandoned, which is a continuation-in-part of Ser. No. 705,299, May 24, 1991.

[51] Int. Cl.[5] ..... F41B 5/00

[52] U.S. Cl. ..... 124/88; 124/25.6; 124/31; 124/35.2

[58] Field of Search ..... 124/23.1, 25.6, 35.1, 124/35.2, 24.1, 86, 88, 89, 90, 91

[56] References Cited

U.S. PATENT DOCUMENTS

| | | | |
|---|---|---|---|
| 3,557,769 | 1/1971 | Hofmeister | 124/88 X |
| 3,561,418 | 2/1971 | Fredrickson | 124/35.2 X |
| 3,998,367 | 12/1976 | Harding | 124/23.1 X |
| 4,121,743 | 10/1978 | Burton | 124/88 X |
| 4,368,719 | 1/1983 | Christopher | 124/25.6 X |
| 4,377,152 | 3/1983 | Saunders | 124/23.1 X |
| 4,603,676 | 8/1986 | Luoma | 124/35.2 X |
| 4,674,472 | 6/1987 | Reis | 124/23.1 X |
| 5,065,732 | 11/1991 | Smith | 124/23.1 X |

*Primary Examiner*—Randolph A. Reese

*Assistant Examiner*—Anthony Knight

*Attorney, Agent, or Firm*—Harold L. Jackson

[57] ABSTRACT

An archery apparatus for optimizing the force exerted on the arrow upon release includes a central section or riser and a pair of resilient limbs extending in opposite directions therefrom. A bowstring is connected between the free ends of the limbs and includes a nocking point for engagement with the nock of an arrow. An arrow rest is carried by the riser and together with the nocking point on the bowstring define a shooting axis along with the arrow travels when departing the bow. A hand grip is mounted on the riser adjacent the shooting axis for accommodating the left or right hand of an archer. A push member extends rearwardly of the riser for accommodating the other hand of the archer. A harness adapted to be worn by the archer includes a bowstring holding and/or releasing mechanism for selectively holding and/or releasing the bowstring adjacent the nocking point. In operation, the archer after putting the harness on, (1) secures the bowstring to the bowstring holding and/or releasing mechanism and flexes the bow limbs by forcing the frame away from his or her body with both arms, (2) removes the hand from the push member, (3) aims the arrow toward a desired target and (4) releases the bowstring from the holding and/or releasing mechanism with the free hand to propel the arrow toward the target.

32 Claims, 4 Drawing Sheets

ARCHERY APPARATUS AND METHOD

BACKGROUND OF THE INVENTION

Related Application

This application is a continuation-in-part of my application Ser. No. 859,998 filed Mar. 30, 1992 for Archery Apparatus and Method, now abandoned, which in turn is a continuation-in-part of my application Ser. No. 705,299 filed May 24, 1991 for Archery Apparatus (hereinafter "299 application").

1. Field of the Invention

The present invention relates to archery equipment in which the force to be imparted to an arrow is held by the archer and more particularly to a bow and bowstring release mechanism and method which optimize the force exerted on the arrow upon release while allowing the archer to actuate the bowstring release mechanism with one hand.

2. Description of the Prior Art

Bow designers have from ancient times sought to increase the speed at which an arrow is launched thereby improving the trajectory, range and destructive power of the arrow.

The efforts of the designers have resulted in a progression of bows from the conventional long bow to the recurved bow and, in more recent times, to the compound bow. To shoot an arrow each bow must be held at arms length with one hand while the other hand and arm pulls the bowstring from its resting position to its full draw (or a desired) position. The force exerted on the bowstring by the archer is commonly referred to as the draw weight. Once the bowstring is in the full draw position, the bow must be held in a steady position while the arrow is aimed at a desired target and then released. The limiting factor on draw weight is the strength of the archer's back muscles and particularly the strength of the back muscles associated with the pulling arm.

The compound bow utilizes eccentric wheels or pulleys mounted on the ends of the bow limbs and a pair of cables in addition to the bowstring connected between the wheels to increase the stored energy (and exit velocity) imparted to an arrow over that available with a recurved bow. The compound bow accomplishes this by providing a peak draw weight intermediate the resting and full draw positions and a lower draw weight at the full draw position to increase steadiness while aiming and maximizing the total stored energy stored in the bow limbs. The difference between the peak draw weight and the full draw weight in percent is commonly referred to as let-off. As the let-off increases the full draw weight decreases as compared to the peak draw weight and visa versa. A compound bow with a let-off of say 40–50%, at full draw, may increase the exit velocity of an arrow from the bow by as much as 40% over a recurved bow having the same draw weight at the full draw position. However, the strength of the archer's back muscles associated with the pulling arm still limits the total draw weight which can be designed into the bow.

Various approaches have been taken in the past to alleviate some of the above problems. To increase an arrow's exit velocity, compound bows have been constructed with increased peak draw weights and let-offs of the order of 30% or less. However, such bows are difficult to hold steady during the aiming process. Even with such decreased let-offs the strength of the archer's back muscles associated with the pulling arm remains the limiting factor on maximum draw weight and energy stored in the limbs.

A bow and body harness arrangement carrying a bowstring release mechanism is described in the '299 application which allows the archer to use one or both arms to force (i.e., push) the bow away from the harness to a full draw position. The bowstring release mechanism may be actuated (e.g., electronically) by one of the hands holding the bow. This type of arrangement of an archery apparatus greatly increases the draw weight which can be designed into any given bow i.e., longbow, recurved or compound bow. However, some competitive events require an archer and some archers prefer to manually release the bowstring with one hand while the other hand is holding the bow in the full draw position. The bow and harness assembly of the '299 application when equipped with a manual bowstring release mechanism will allow an archer to compete in such events by using both hands and arms to force the bow away from the harness to its full draw position while facing the target, then hold the bow with one hand in that position and actuate the bowstring release mechanism with the other hand.

Archers generally stand sideways to the target to maximize the rearward deflection of the bowstring and provide a more stable platform for the single arm holding the bow. While an archer can rotate his or her body from a front facing position to a sideways position after achieving a full draw with the '299 apparatus, I have eliminated the need for this motion and increased the bowstring deflection during the two arm draw operation by adding a push member which extends rearwardly of the riser or central section of the bow in addition to the conventional single handgrip. With my improvement, an archer may push the bow away from his or her body and the harness with one hand on the conventional handgrip and the other hand on the push member while standing (or turning) sideways to the target.

SUMMARY OF THE INVENTION

An archery apparatus in accordance with the present invention comprises a bow having a central section or riser including a handgrip for receiving one hand of an archer with which the archer may draw and hold the bow in a desired draw position. A pair of resilient limbs extend in opposite directions from the riser. A bowstring is connected between the ends of the limbs and extends rearwardly of the riser. A push member which may conveniently be in the form of an elongated rod or bar is mounted to and extends rearwardly from the central section to a terminal end which may be in the form of an enlarged knob. The terminal end of the push member or knob is adapted to receive the other hand of the archer. A harness assembly, adapted to be worn on the torso of the archer, carries a bowstring holding and/or release mechanism, preferably manually actuated, for selectively holding and/or releasing the bowstring.

In launching an arrow with the apparatus, the archer secures the harness to his or her torso and then secures the bowstring in the bowstring holding and/or release mechanism. An arrow may be placed on the bow so that the bowstring is seated within the nock of the arrow. One hand (right or left) is then placed on the handgrip and the other hand is placed on the terminal end of the push member. The bow's riser (and attached limbs) is then forced or pushed away from the archer's body with both arms until the bow is in the full or desired draw position. The other hand is then removed from the push member and used to release the bowstring to propel the arrow toward a desired target.

The features of the present invention can best be understood from the following description taken in conjunction with the drawings wherein like reference numerals designate like components.

DESCRIPTION OF THE PREFERRED EMBODIMENT

Figure 1:
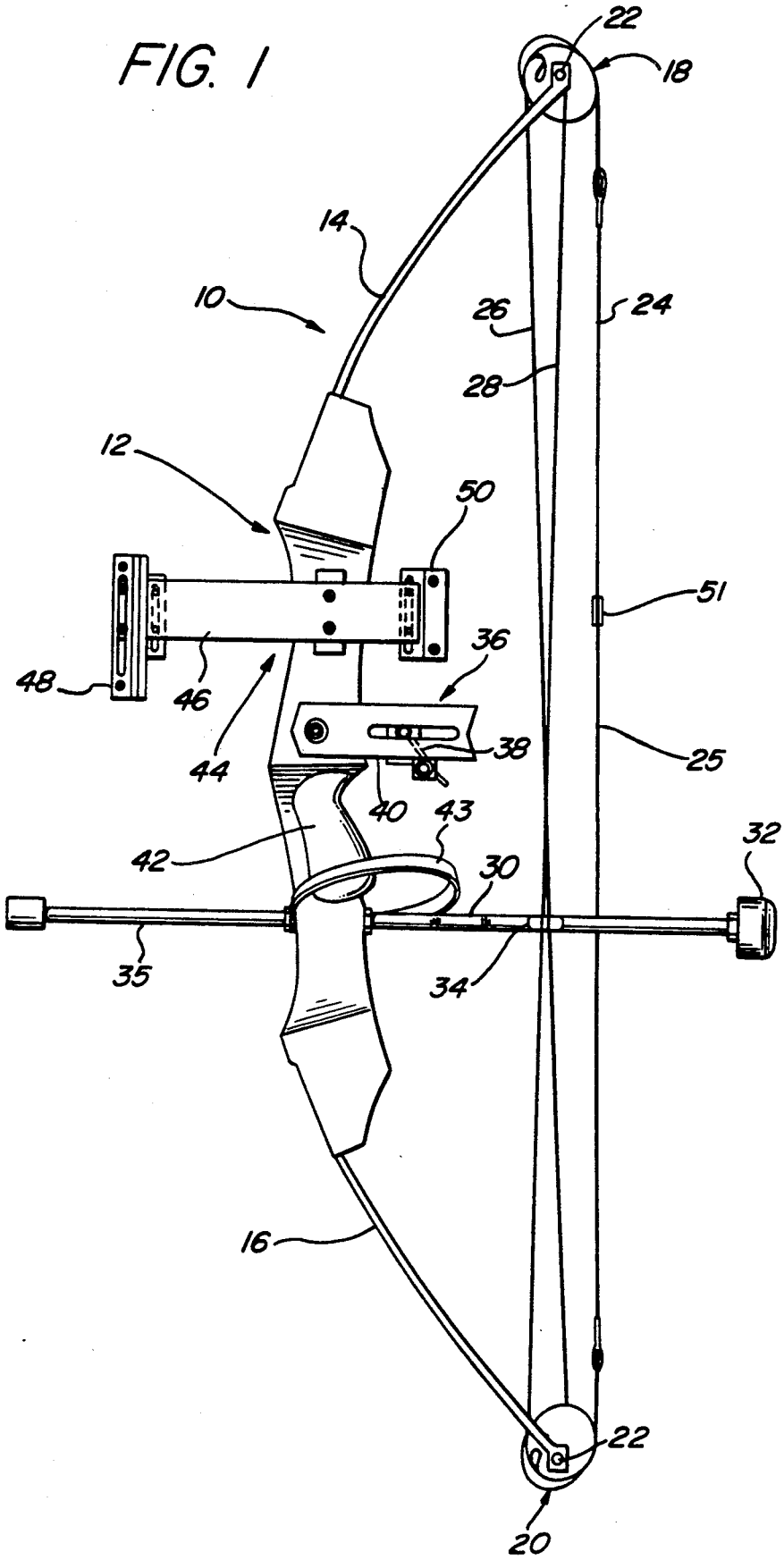
FIG. 1 is a side elevational view of a bow in accordance with this invention.

Referring now to the drawings and particularly to FIG. 1, a compound bow 10 includes an elongated central section or riser 12. The riser 12 may be made of aluminum or other suitable material. Flexible limbs 14 and 16, made of conventional materials such as glass fibers and resin (e.g. Fiberglas®), carbon or graphite composites, are secured to each end of the riser 12 via bolts or other fasteners (not shown) in a conventional manner. (Fiberglas is a trademark of Owens Corning).

Conventional eccentric wheels or cammed pulleys 18 and 20 are rotatably mounted on the ends of the limbs 14 and 16, via shafts 22, respectively. A bowstring 24 has its ends connected to the pulleys as illustrated and includes a nocking point 25 adapted to engage the nock on an arrow. A pair of cables 26 and 28 have one end connected to a respective shaft 22 and the other end connected to a respective pulley. This arrangement is typical and provides the let-off inherent in compound bows as discussed earlier.

A cable guard 30 in the form of an elongated rod is mounted on the riser 12 via suitable means and extends horizontally with respect to the vertically oriented riser 12. The cable guard terminates in an enlarged knob 32 for accommodating one hand of an archer during the draw operation as will be described. The cable guard and knob may be made of suitable material such as aluminum with the knob threaded onto the end of the rod 30. The cable guard 30 and knob 32 are sometimes referred to hereinafter as the "push member" or "second handgrip". A conventional cable guide 34 is slidably mounted on the cable guard 30 as illustrated. The cables 26 and 28 are secured to the cable guide 34 via grooves (not shown). The cable guide holds the cables to one side of the plane through which the bowstring moves so that the cables will not interfere with the path of the arrow shaft and its vanes. A conventional stabilizer rod 35 is secured to and extends forwardly of the riser 12 as shown.

A conventional arrow rest 36 in the form of two spring biased metal pegs 38 (only one of which is shown) and horizontal bracket 40, is mounted on the riser 12 by a suitable bolt. The bracket 40 has a slot therein to allow adjustment of the horizontal position of the pegs 38. The pegs 38 support the shaft of the arrow while allowing the free passage of the vanes as is well known in the art.

The riser 12 includes a conventional handgrip 42 (sometimes referred to herein as the "first handgrip") with which the archer may draw and hold the bow in the full or a desired draw position. A leather strap 43 is secured to the riser 12 adjacent the handgrip 42 for aiding the archer in holding the bow steady in the full draw position.

A bow sight 44 comprises a horizontal bracket 46 mounted on the riser by suitable bolts and front and rear sight portions 48 and 50 mounted to the bracket 46. The front sight 48 may include a vertical cross-hair 70 (not shown) and one or more horizontal range lines (not shown). The rear right may include a vertical cross-hair (not shown) to enable the archer to properly align the bow and arrow with a desired target.

A conventional peep sight 52 is carried by the bowstring so that when the bowstring is at its full draw position the archer can by looking through the peep sight align the front and rear bow sights with the target.

Figure 2:
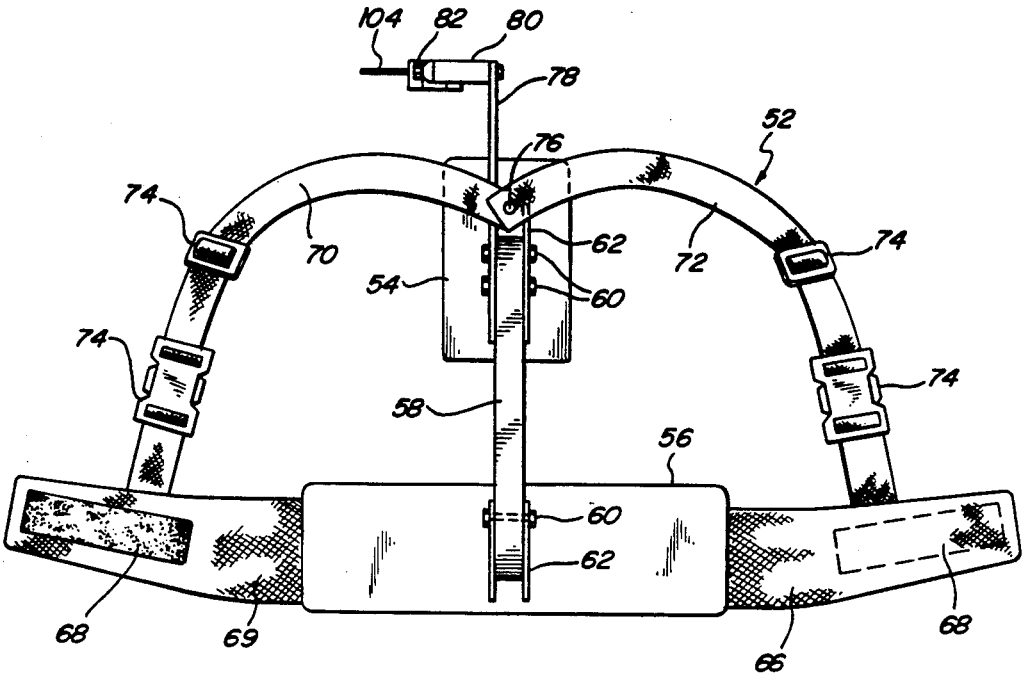
FIG. 2 is a rear elevational view of a harness assembly in accordance with the invention.

Referring now to FIG. 2, a harness assembly 52 includes a rigid back plate 54 pivotally connected to a flexible belt or strap 56 via a bar 58, bolts 60 and rigid channel brackets 62. The belt 56 includes extended arm portions 64 and 66 which are arranged to wrap around the archer's waist and be releasably secured together by a suitable fastener such as velcro strips 68. Shoulder straps 70 and 72, provided with adjustable buckles 74, are suitably secured to the belt extensions 64 and 66 (e.g. by sewing) and the back plate via a rivet 76. The back plate 54 may be curved to conform to the archer's back and padded for the comfort.

Figure 3:
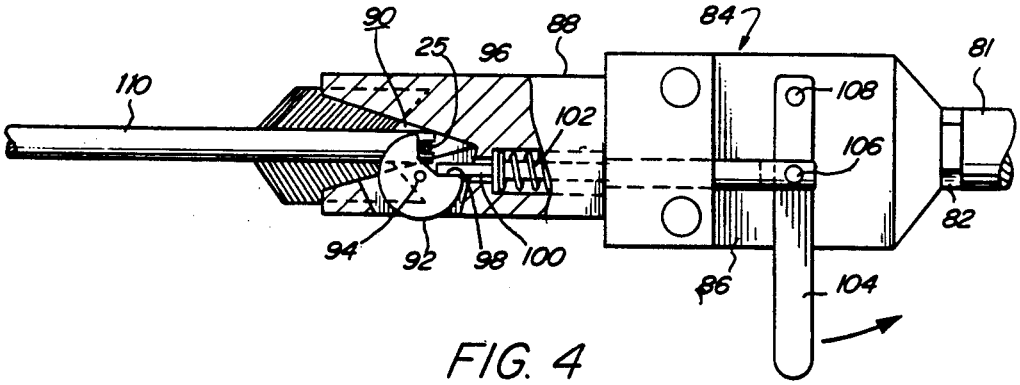
FIG. 3 is an enlarged top plan view, partially broken away, of a bowstring or arrow release mechanism carried by the harness of FIG. 2 showing the bowstring retaining position.
Figure 4:
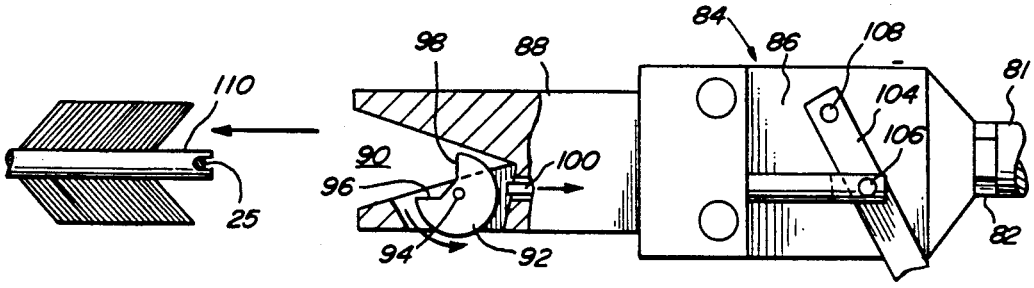
FIG. 4 is a top plan view, partially broken away, of the release mechanism in the release position.
Figure 7:
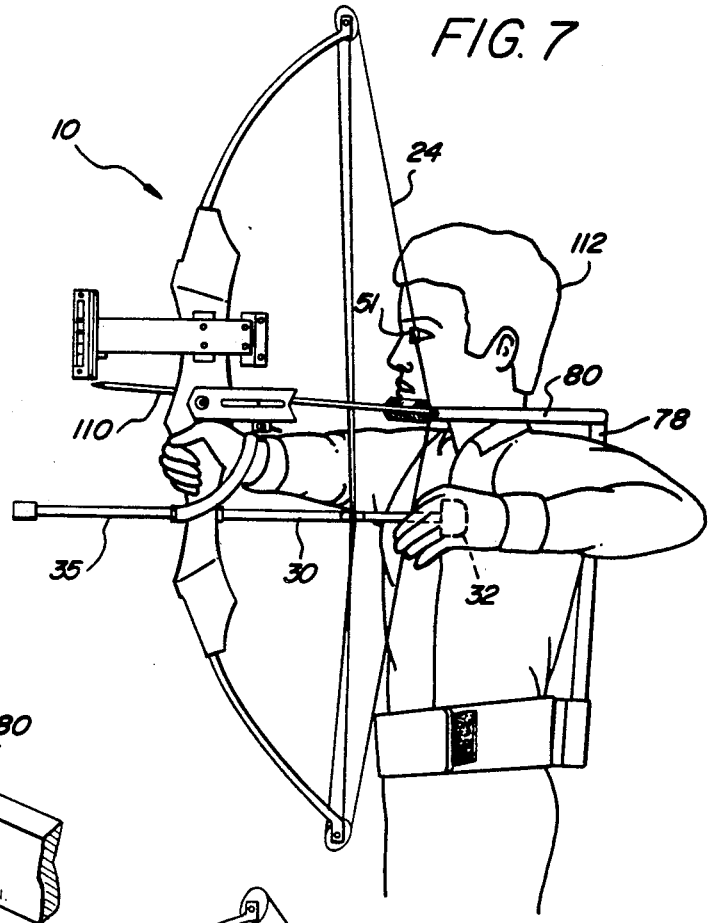
FIG. 7 is a side elevational view similar to FIG. 5 except that the bowstring release mechanism carried by the harness has been replaced with a bowstring holding mechanism.
Figure 9:
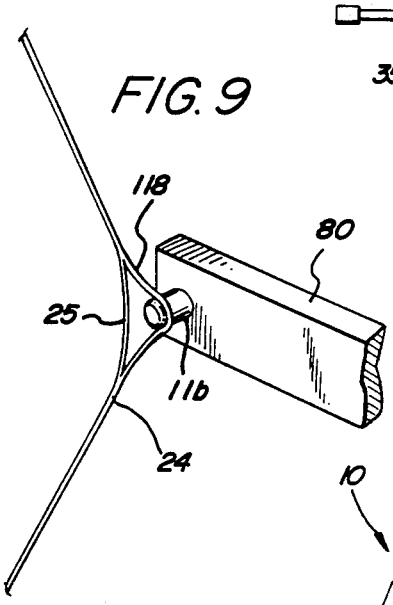
FIG. 9 is an enlarged perspective view, partially broken away, of the holding mechanism carried by the harness of FIGS. 7 and 8.
Figure 8:
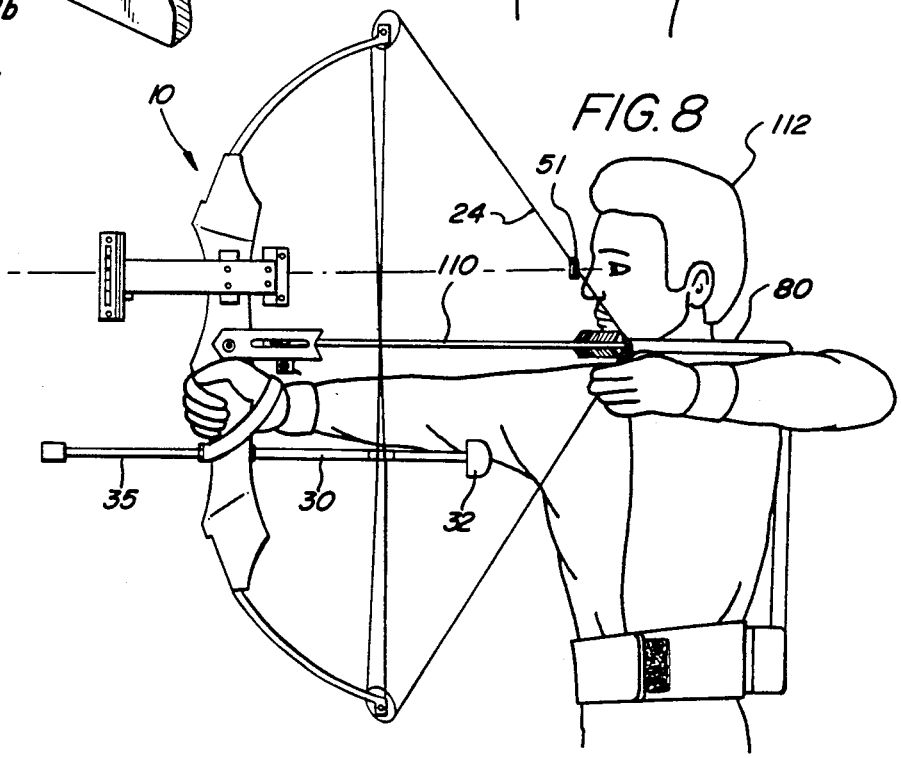
FIG. 8 is a side elevational view similar to FIG. 7 showing the bow in the full draw position with one of the archer's hands on the bowstring for removing the bowstring from the holding mechanism and subsequently releasing the bowstring.

A vertical extension bar 78 is bolted to the pivot bar 58 and upper channel bracket 62 adjacent the back plate 54. An L-shaped horizontal bracket member 80 is bolted to the end of the vertical extension bar 78. A bowstring holding and/or release mechanism is suitable secured to the end 81 of the bracket 80 for holding the bowstring during the draw operation. The holding mechanism may include a manually actuated release as is illustrated in FIGS. 2, 3, and 4 or may be arranged to only hold the bowstring as is illustrated in FIGS. 7, 8, and 9. The bowstring holding and release mechanism shown in FIG. 2 is identified by reference numeral 84 and is suitably secured to the end 81 of the bracket 80 by suitable means such as a threaded connection 82.

The bowstring holding and release mechanism 84, illustrated in FIGS. 3 and 4, comprises a body 86 having a cylindrical front section 88 with a V-shaped opening 90 therein for receiving the bowstring adjacent the nocking point 25 thereof. A sear 92 in the form of a notched cylindrical plate is rotatably mounted on pin 94 in the front section 88 and protrudes into the opening 90 as illustrated. The sear includes a bowstring griping or retaining surface 96 which engages the bowstring and a latching surface 98 which engages a plunger 100. The plunger 100 is biased by a spring 102 against the sear 92 and prevents rotation thereof in the bowstring retaining position as is illustrated in FIG. 3. The sear 92 extends beyond the outer surface of the cylindrical section 88 so that it may be manually rotated from the release position of FIG. 4 (after the bowstring is inserted into the opening 90) to its retention position of FIG. 3. It should be noted that the bowstring may include a loop extending around the nocking point 25 for insertion into the release mechanism as described in the '299 application.

The plunger 100 is pivotally mounted to a manually actuated lever 104 by pin 106. The lever 104 is in turn pivotally mounted by pin 108 to the body 86 so that the archer may release the bowstring and arrow by rotating the lever counterclockwise as shown.

Figure 5:
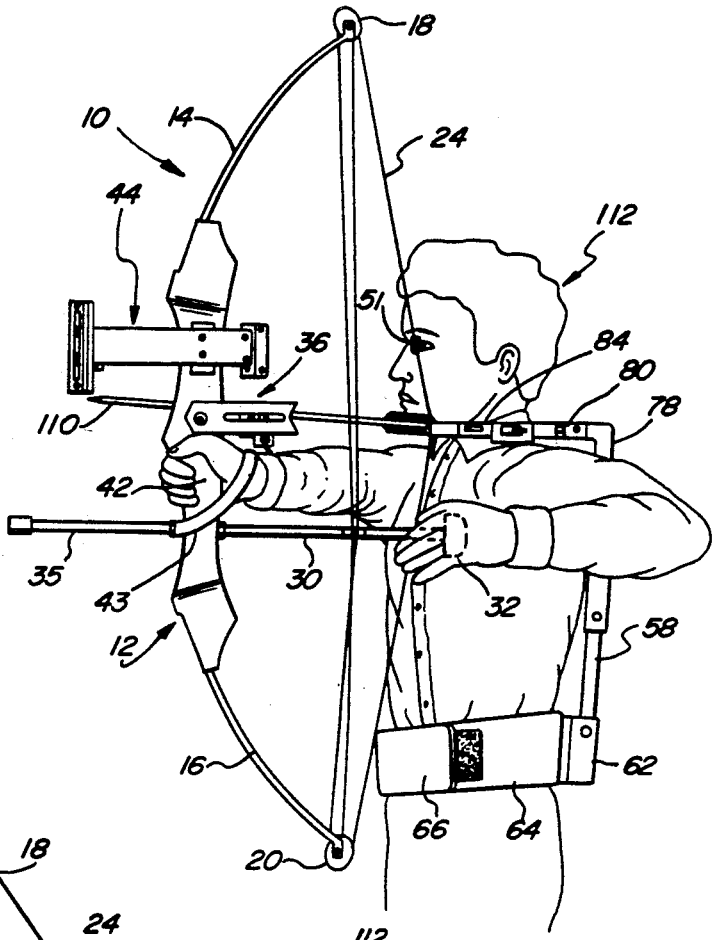
FIG. 5 is a side elevational view of the bow held by an archer at the beginning of the draw operation with the harness assembly strapped to the archer's body.

The method of using the archery apparatus of FIGS. 1–4 will now be explained in reference to FIGS. 5 and 6. Initially the archer (designated 112) straps the harness around his or her body or torso so that the back plate is positioned along the upper back and the bowstring holding and release mechanism 84 is positioned over one shoulder and adjacent the neck. An arrow is placed on the arrow rest and the nock thereof on the bowstring. It should be noted that the shoulder straps are not shown in FIGS. 5 and 6.

The archer after confirming that the sear 92 of the bowstring holding and release mechanism is in its release position as illustrated in FIG. 4 (manually rotating the sear while the lever is pivoted counterclockwise if necessary) positions the bow adjacent the harness, inserts the bowstring into the opening 90 and turns the sear to its retention position as is illustrated in FIG. 3. The archer then places one hand, such as the right hand, on the hand grip 42 and the other hand on the knob 32. The archer (while preferably standing or turning sideways to the target) pushes the bow away from the body and harness with both arms. See FIG. 5. With the bowstring in its full draw position the archer removes the hand (e.g. left hand) from the knob 32 and aligns the bow and arrow with a desired target as viewed through the peep sight. The hand which has been removed from the knob 32 actuates the bowstring release mechanism by rotating the lever 104 counterclockwise, preferably with one finger. The rotation of lever 104 withdraws the plunger 100 and allows the sear 92 to release the bowstring. Upon release the bowstring accelerates the arrow to a velocity which may be one hundred and fifty percent or more of the velocity achievable with prior art compound bows. The bow may now be prepared to shoot another arrow.

Referring now to FIG. 7, 8, and 9, the bowstring holding and release mechanism 84 has been replaced by a bowstring holding mechanism 116 in the form of a horizontally extending peg which engages the bowstring or a loop 118 which attaches to the bowstring on either side of the nocking point 25. The peg 116 is secured to the forward end of the L-shaped bracket 80 as shown.

Figure 6:
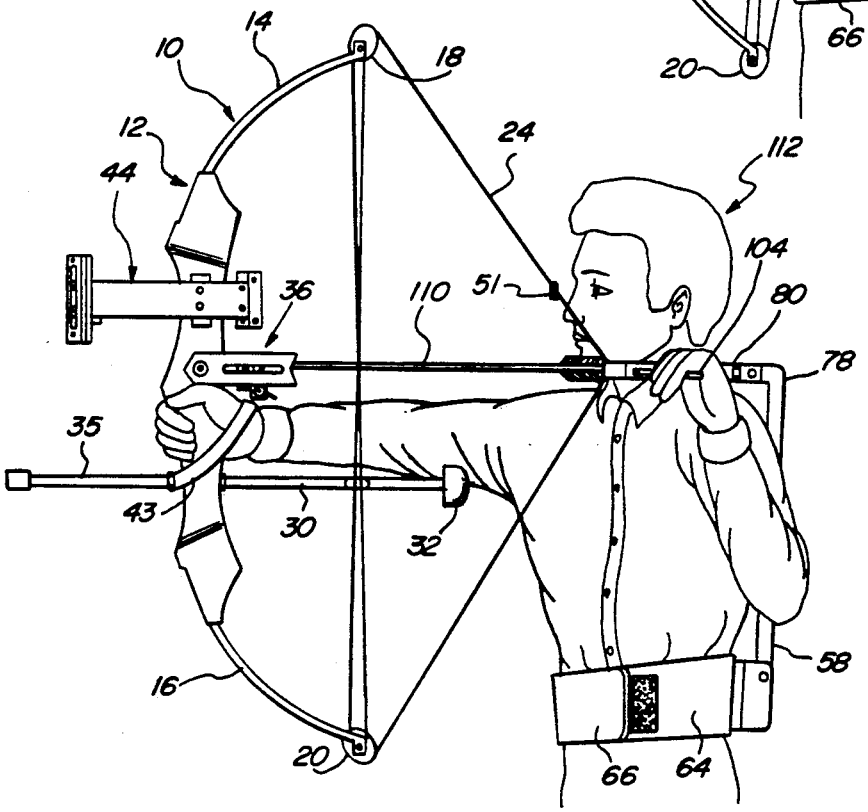
FIG. 6 is a side elevational view similar to FIG. 5 showing the bow in the full draw position with one of the archer's hands on the bowstring release mechanism.

The bow of FIGS. 7–9 is operated in the same manner as the bow of FIGS. 6 and 7 except that the bowstring 24 or loop 116 is inserted over the peg 116 prior to the draw operation. After the bowstring is in the full draw position, the archer may remove the hand from knob 32 (e.g. left hand as shown in FIG. 8) and pull the bowstring rearwardly until the loop 118 is disengaged from the peg 116. The archer may then release the bowstring in a conventional manner.

A bow in accordance with my invention may be designed for considerably higher draw weights because both of the archer's arms and body are used to force the bowstring to its full draw position. For example, maximum peak draw weights with compound bows of the order 150 or more pounds with a 50–65% let-off are achievable with my invention as contrasted to peak draw weights of 50 to 80 pounds with conventional adult compound bows. The exit velocity of an arrow can be increased accordingly with the use of my invention over the use of conventional bows. In shooting a conventional bow an archer utilizes the upper back muscles (of one arm) in a pulling action. An archer shooting my bow utilizes the tricep muscles in both arms as well as the major pectoral and back muscles in a pushing action (e.g. similar to a weight lifting bench press action). While my invention is particularly useful with compound bows with let offs it is also useful with other bows. It should be noted that the push member need not take the form of an extension of a conventional cable guard. However, the push member preferably extends rearwardly of the riser a sufficient distance, e.g., 8–16 inches and preferably about 12 inches, so that an archer's arm and hand pushing on the push member can contribute to the full drawing operation, that is until the arm holding the bow is straight with the body turned sideways. It should also be noted that the harness could be arranged to fit around the base of the archer's neck instead of a major portion of the back area. The term torso as used herein is intended to cover both areas of the body.

There has been described an archery apparatus which provides a significant improvement in the trajectory, range, destructive power and accuracy of the arrow.

Various modifications to the described apparatus will be apparent to those skilled in the art without involving any departure from the spirit and scope of my invention as defined in the appended claims.

What is claimed is:

1. An archery apparatus for launching arrows comprising:

a bow having:

a riser including a handgrip for receiving one hand of the archer with which an archer may draw and hold the bow in a desired draw position;

a pair of resilient limbs extending in opposite directions from the riser;

a bowstring connected between the ends of the limbs and having a nocking point, the bowstring located rearwardly of the riser;

an arrow rest affixed to the riser for supporting the shaft of the arrow, the arrow rest and nocking point aligning the arrow on a shooting axis along which the arrow travels when departing the bow;

a push member secured to the riser for receiving the other hand of the archer; and a harness assembly having means for being secured to the torso of the archer and for selectively holding and/or releasing the bowstring adjacent the nocking point, whereby the archer may secure the harness assembly to his or her torso, secure the bowstring to the bowstring holding and/or releasing means on the harness, place the nock of an arrow upon the bowstring, flex the bow limbs by forcing the riser away from the harness with both arms until the bow is in a desired draw position, and then release the bowstring with said other hand to propel the arrow toward a desired target.

2. The invention of claim 1 wherein the push member extends rearwardly of the riser.

3. The invention of claim 2 wherein the push member extends rearwardly from the riser within the range of 8 to 16 inches.

4. The invention of claim 2 wherein the bowstring and/or releasing means comprises means for only holding the bowstring.

5. The invention of claim 4 wherein the holding means comprises a peg extending generally perpendicular to the plane of movement of the bowstring.

6. The invention of claim 4 wherein the bow is a compound bow including a cable guard.

7. The invention of claim 6 wherein the cable guard forms the push member.

8. The invention of claim 7 wherein the cable guard includes a knob for receiving the other hand of the archer.

9. The invention of claim 8 wherein the bowstring holding means includes a bowstring engaging member and the harness is constructed and arranged to position the bowstring engaging member adjacent one shoulder and the neck of an archer.

10. The invention of claim 9 wherein the harness includes a back plate adapted to rest against the archer's back and straps for releasably securing the backplate to the archer.

11. The invention of claim 2 wherein the bowstring holding and/or releasing means comprises means for selectively holding and releasing the bowstring.

12. The invention of claim 11 wherein the bowstring holding and releasing means includes a manually actuated lever.

13. The invention of claim 12 wherein the bow is a compound bow including a cable guard.

14. The invention of claim 13 wherein the cable guard forms the push member.

15. The invention of claim 14 wherein the cable guard includes a knob for receiving the other hand of the archer.

16. The invention of claim 15 wherein the bowstring holding means includes a bowstring engaging member and the harness is constructed and arranged to position the bowstring engaging member adjacent one shoulder and the neck of an archer.

17. The invention of claim 16 wherein the harness includes a back plate adapted to rest against the archer's back and straps for releasably securing the backplate to the archer.

18. The archery apparatus of claim 17 wherein the bowstring holding and releasing means further includes a body and a bowstring engaging member pivotally mounted on the body for movement between a retaining position in which the engaging member engages the bowstring and a release position in which the engaging member disengages the bowstring.

19. The invention of claim 18 wherein the bowstring holding and releasing means further includes a manually actuated lever for actuating the bowstring engaging member to disengage the bowstring.

20. The invention of claim 19 wherein the cable guard extends rearwardly from the riser within the range of 8 to 16 inches.

21. The invention of claim 20 wherein the cable guard is positioned below the hand grip.

22. In a method of launching an arrow with an archery apparatus including a bow with a central section having a handgrip adapted to receive one hand of an archer, a pair of resilient limbs extending in opposite directions from the central section, a bowstring connected between the ends of the limbs and located rearwardly of the central section, a push member secured to the central section and extending rearwardly therefrom to a terminal end adapted to receive the other hand of the archer and a harness assembly having means secured to the torso of the archer and including a bowstring holding and/or releasing mechanism, the steps comprising:

a) securing the harness to the torso;
b) placing an arrow on the bow so that the bowstring is seated within the nock of the arrow;
c) securing the bowstring to the bowstring holding and/or releasing mechanism;
d) placing one hand on the handgrip and the other hand on the terminal end of the push member;
e) forcing the central section of the bow away from the torso with both arms until the bow is in its desired draw position;
f) removing the other hand from the push member; and
g) releasing the bowstring from the bowstring holding and/or releasing mechanism with the other hand to propel the arrow toward a desired target.

23. The method of claim 22 wherein the step of drawing the bow is accomplished while standing sideways to the target.

24. The method of claim 23 wherein the bowstring holding and/or releasing mechanism includes a manually actuated lever for releasing the bowstring and wherein the step of releasing the bowstring release comprises the use of a finger of said other hand.

25. In a method of launching an arrow with an archery apparatus including a bow with a central section having a handgrip adapted to receive one hand of an archer, a pair of resilient limbs extending in opposite directions from the central section, a bowstring connected between the ends of the limbs and extending rearwardly of the central section, a push member secured to the central section and extending rearwardly therefrom to a terminal end adapted to receive the other hand of the archer and a harness assembly having means to be secured to the torso of the archer and including a manually actuated bowstring holding and releasing mechanism, the steps comprising:

a) securing the harness to the torso;
b) placing an arrow on the bow so that the bowstring is seated within the nock of the arrow;
c) securing the bowstring to the bowstring holding and releasing mechanism;
d) placing one hand on the handgrip and the other hand on the terminal end of the push member;
e) forcing the central section of the bow away from the torso with both arms until the bow is in its desired draw position;
f) removing the other hand from the push member; and g) actuating the bowstring holding and releasing mechanism with the other hand to propel the arrow toward a desired target.

26. In a method of launching an arrow with an archery apparatus including a bow with a central section having a handgrip adapted to receive one hand of an archer, a pair of resilient limbs extending in opposite directions from the central section, a bowstring connected between the ends of the limbs and located rearwardly of the central section, a push member secured to the central section and extending rearwardly therefrom to a terminal end adapted to receive the other hand of the archer and a harness assembly having means to be secured to the torso of the archer and including a bowstring holding mechanism, the steps comprising:

a) securing the harness to the torso;

b) placing an arrow on the bow so that the bowstring is seated within the nock of the arrow;

c) securing the bowstring to the bowstring holding mechanism;

d) placing one hand on the handgrip and the other hand on the terminal end of the push member;

e) forcing the central section of the bow away from the torso with both arms until the bow is in its desired draw position;

f) removing the other hand from the push member; and g) releasing the bowstring from the bowstring holding mechanism and releasing the bowstring with the other hand to propel the arrow toward a desired target.

27. An archery apparatus for launching arrows comprising:

a bow having;

a riser including a first handgrip for accommodating one hand of an archer, and a second handgrip for accommodating the other hand of the archer, the second handgrip being positioned rearwardly of the first handgrip;

a pair of resilient limbs extending from the riser;

a bowstring connected between the ends of the limbs and located rearwardly of the riser;

a harness assembly having means to be secured to the torso of the archer; and a manually actuated bowstring holding and releasing mechanism carried by the harness and positioned adjacent one shoulder and neck of the archer when the harness is secured to the archer's torso, whereby the archer may secure the harness assembly to his or her body, secure the bowstring to the bowstring holding and releasing mechanism, place an arrow on the bow with its nock on the bowstring, flex the bow limbs by pushing the riser away from his or her body using both arms until the bow is in a desired draw position, remove the other hand from the second handgrip so that it is free from the bow and then actuate the bowstring holding and releasing mechanism with the free hand to propel the arrow toward a desired target.

28. The invention of claim 27 wherein the second handgrip extends rearwardly of the riser.

29. The invention of claim 28 wherein the second handgrip extends rearwardly from the riser within the range of 8 to 16 inches.

30. The invention of claim 28 wherein the bowstring holding and releasing mechanism includes a manually actuated lever.

31. The invention of claim 30 wherein the bow is a compound bow including a cable guard with an enlarged knob at the terminal end.

32. The invention of claim 31 wherein the knob on the cable guard forms the second handgrip.

* * * * *

UNITED STATES PATENT AND TRADEMARK OFFICE

CERTIFICATE OF CORRECTION

PATENT NO. : 5,243,959

DATED : September 14, 1993

INVENTOR(S) : Huey P. Savage

It is certified that error appears in the above-identified patent and that said Letters Patent is hereby corrected as shown below:

[*] Notice

--The portion of the term of this patent subsequent to April 27, 2010 has been disclaimed.--

Signed and Sealed this

Third Day of May, 1994

Bruce Lehman

*Attest:*

BRUCE LEHMAN

*Attesting Officer*

*Commissioner of Patents and Trademarks*